US009280978B2

(12) United States Patent
Kim et al.

(10) Patent No.: US 9,280,978 B2
(45) Date of Patent: Mar. 8, 2016

(54) PACKET LOSS CONCEALMENT FOR BANDWIDTH EXTENSION OF SPEECH SIGNALS

(71) Applicant: GWANGJU INSTITUTE OF SCIENCE AND TECHNOLOGY, Gwangju (KR)

(72) Inventors: Hong-Kook Kim, Gwangju (KR); Nam-In Park, Gwangju (KR)

(73) Assignee: Gwangju Institute of Science and Technology, Gwangju (KR)

( * ) Notice: Subject to any disclaimer, the term of this patent is extended or adjusted under 35 U.S.C. 154(b) by 337 days.

(21) Appl. No.: 13/851,245

(22) Filed: Mar. 27, 2013

(65) Prior Publication Data

US 2013/0262122 A1 Oct. 3, 2013

Related U.S. Application Data

(60) Provisional application No. 61/615,910, filed on Mar. 27, 2012.

(51) Int. Cl.
*G10L 19/02* (2013.01)
*G10L 19/005* (2013.01)
(Continued)

(52) U.S. Cl.
CPC ..... *G10L 19/02* (2013.01); *G10L 19/005* (2013.01); *G10L 19/0212* (2013.01); *G10L 21/0388* (2013.01)

(58) Field of Classification Search
CPC ..... G10L 19/005; G10L 19/02; G10L 19/18; G10L 19/26; G10L 21/038; G10L 25/93
USPC ..... 704/200.1, 203, 205, 208, 214, 500, 704/501
See application file for complete search history.

(56) References Cited

U.S. PATENT DOCUMENTS 5,455,888 A 10/1995 Iyengar et al.
6,985,856 B2 * 1/2006 Wang et al. ..... 704/226
(Continued)

FOREIGN PATENT DOCUMENTS

KR 10-2006-0078362 A 7/2006
KR 10-2009-0053520 A 5/2009

OTHER PUBLICATIONS

Notice of Allowance dated May 14, 2014, in Korean Application No. 10-2012-0069777.

*Primary Examiner* — Martin Lerner
(74) *Attorney, Agent, or Firm* — Saliwanchik, Lloyd & Eisenschenk

(57) ABSTRACT

Disclosed is a speech receiving apparatus. A low-band PLC module and a synthesis filter reconstructs a low-band speech signal of a lost frame from a previous good frame. A high-band PLC module reconstructs a high-band speech signal of the lost frame from the previous good frame. A transforming part transforms the low-band speech signal into a frequency range. A bandwidth extending part generates at least an extended MDCT coefficient as information for the high-band speech signal from the low-band speech signal transformed by the transforming part. A smoothing part smoothes the extended MDCT coefficient. An inverse transforming part inversely transforms the extended MDCT coefficient smoothed by the smoothing part to a time domain. A synthesizing part synthesizes the low-band speech signal, and the high-band speech signal which is inverse-transformed by the inverse transforming part and reconstructed, to output a wide-band speech signal.

16 Claims, 4 Drawing Sheets

(51) Int. Cl.

| | |
|---|---|
| ***G10L 21/038*** | (2013.01) |
| ***G10L 25/93*** | (2013.01) |
| ***G10L 21/0388*** | (2013.01) |

(56) References Cited

U.S. PATENT DOCUMENTS

| | | | | |
|---|---|---|---|---|
| 7,191,123 | B1 * | 3/2007 | Bessette et al. | 704/225 |
| 7,552,048 | B2 * | 6/2009 | Xu et al. | 704/206 |
| 7,805,297 | B2 * | 9/2010 | Chen | 704/228 |
| 8,170,885 | B2 * | 5/2012 | Kim | G10L 19/0208 375/242 |
| 8,355,911 | B2 * | 1/2013 | Zhan et al. | 704/228 |
| 8,457,115 | B2 * | 6/2013 | Zhan et al. | 704/219 |
| 8,527,265 | B2 * | 9/2013 | Reznik | G10L 19/24 704/200 |
| 8,731,910 | B2 * | 5/2014 | Wu et al. | 704/204 |
| 8,909,539 | B2 * | 12/2014 | Kim | G10L 19/02 375/240 |
| 8,990,073 | B2 * | 3/2015 | Malenovsky et al. | 704/208 |
| 2002/0016698 | A1 * | 2/2002 | Tokuda | G10L 21/038 702/190 |
| 2002/0128839 | A1 | 9/2002 | Lindgren et al. | |
| 2005/0049853 | A1 * | 3/2005 | Lee | G10L 19/005 704/201 |
| 2007/0282599 | A1 * | 12/2007 | Choo et al. | 704/205 |
| 2008/0177532 | A1 * | 7/2008 | Greiss et al. | 704/200.1 |
| 2009/0138272 | A1 * | 5/2009 | Kim | G10L 19/24 704/500 |
| 2009/0240490 | A1 * | 9/2009 | Kim | G10L 19/005 704/207 |
| 2009/0248405 | A1 * | 10/2009 | Chen et al. | 704/219 |
| 2009/0278573 | A1 * | 11/2009 | Tashiro | G10L 21/038 327/113 |
| 2009/0326946 | A1 * | 12/2009 | Cox | G10L 15/02 704/256.1 |
| 2011/0002266 | A1 * | 1/2011 | Gao | 704/200.1 |
| 2012/0226505 | A1 * | 9/2012 | Lin | G10L 19/002 704/500 |
| 2013/0035943 | A1 * | 2/2013 | Yamanashi | G10L 19/24 704/500 |
| 2013/0151255 | A1 * | 6/2013 | Kim | G10L 19/02 704/268 |

* cited by examiner

PACKET LOSS CONCEALMENT FOR BANDWIDTH EXTENSION OF SPEECH SIGNALS

CROSS-REFERENCE TO RELATED APPLICATION

This application claims the benefit under 35 U.S.C. §119 of U.S. Patent Application No. 61/615,910, filed Mar. 27, 2012, which is hereby incorporated by reference in its entirety.

BACKGROUND

The present disclosure relates to a speech receiving apparatus and a speech receiving method.

With the increasing use of the internet, IP telephony devices based on voice over IP (VoIP) and voice over WiFi (VoWiFi) technologies have attracted have attracted considerable attention for speech communication.

In IP phone services, speech packets are typically transmitted using a real-time transport protocol/user datagram protocol (RTP/UDP). However, the RTP/UDP does not verify whether the transmitted packets are correctly received. Owing to the nature of this type of transmission, the packet loss rate increases with increasing network congestion. In addition, depending on the network resources, the possibility of burst packet losses also increases. Such a loss increase potentially results in severe quality degradation of the reconstructed speech.

Meanwhile, most speech coders in use today are based on telephone-bandwidth narrowband speech, nominally limited to about 300-3,400 Hz at a sampling rate of 8 kHz. Accordingly, the enhancement in speech quality is limited.

In contrast, wideband speech coders have been developed for the purpose of smoothly migrating from narrowband to wideband quality (50-7,000 Hz) at a sampling rate of 16 kHz in order to improve speech quality in voice service. For example, ITU-T Recommendation G.729.1, a scalable wideband speech coder, improves the quality of speech by encoding the frequency bands ignored by the narrowband speech coder, ITU-T G.729. Therefore, encoding wideband speech using ITU-T G.729 is performed via two different approaches according to the frequency band. Specifically, the two different approaches are applied to the low-band and high band in the time and frequency domains, respectively. As such a method, a method of coding information of high band at an upper layer of a transmission packet and transmitting the coded information is selected.

Meanwhile, an input frame may be erased due to a speech packet loss while speech is decoded, and the speech packet loss may occur due to various causes such as poor surroundings, etc. When a frame erasure occurs, the erased frame is reconstructed using a frame erasure concealment algorithm. For example, in ITU-T G.729.1, the low-band and high-band packet loss concealment (PLC) algorithms work separately. In detail, the low-band PLC algorithm reconstructs a speech signal of the lost frame from the excitation, pitch and linear prediction coefficient of the last good frame. On the other hand, the high-band PLC algorithm reconstructs the spectral parameters such as typically modified discrete cosine transform (MDCT) coefficients of the lost frame from the last good frame.

Meanwhile, when a frame erasure occurs, the signal reconstructed using the low-band PLC algorithm exhibits more enhanced performance than that reconstructed using the high-band PLC algorithm. Therefore, a method of improving a wideband speech signal with good quality by improving the quality of the high-band PLC algorithm is strongly required.

BRIEF SUMMARY

Embodiments provide a speech receiving apparatus and a speech receiving method in which when a packet loss occurs, a low-band PLC algorithm having a high efficiency in reconstruction of a speech signal, and a reconstruction result thereof may be used to reconstruct a high-band signal, thereby obtaining a more complete speech signal.

Embodiments also provide a speech receiving apparatus and a speech receiving method in which a reconstructed low-band speech signal is used for reconstructing a high-band speech signal by applying a bandwidth extension technology.

In one embodiment, a speech receiving apparatus includes: a low-band PLC module and a synthesis filter reconstructing a low-band speech signal of a lost frame from a previous good frame; a high-band PLC module reconstructing a high-band speech signal of the lost frame from the previous good frame; a transforming part transforming the low-band speech signal to a frequency domain; a bandwidth extending part generating at least an extended MDCT coefficient as information for the high-band speech signal from the low-band speech signal transformed by the transforming part; a smoothing part smoothing the extended MDCT coefficient; an inverse transforming part inversely transforming the extended MDCT coefficient smoothed by the smoothing part to a time domain; and a synthesizing part synthesizing the low-band speech signal, and the high-band speech signal which is inverse-transformed by the inverse transforming part and reconstructed, to output a wideband speech signal.

In another embodiment, a speech receiving method includes: reconstructing a low-band speech signal of a lost frame from a previous good frame; transforming the reconstructed low-band speech signal to a frequency domain to provide a low-band MDCT coefficient; processing the low-band MDCT coefficient by different methods according to the frequency range of the high band, which are classified into at least two cases, to provide an extended MDCT coefficient of a high-band speech signal; inversely transforming the extended MDCT coefficient to a time domain to reconstruct the high-band speech signal; and synthesizing the reconstructed high-band speech signal and the low-band speech signal.

In further another embodiment, a speech receiving method includes: reconstructing a low-band speech signal of a lost frame from a previous good frame and transforming the reconstructed low-band speech signal to a frequency domain to provide a low-band MDCT coefficient; and providing at least an extended MDCT coefficient by different methods according to whether input speech is voiced or unvoiced speech to a frequency domain which is at least a part of a high band.

According to the present invention, even when a packet loss occurs, a high-band speech may be reconstructed using the bandwidth extension technology, thereby enhancing the quality of a received speech.

The details of one or more embodiments are set forth in the accompanying drawings and the description below. Other features will be apparent from the description and drawings, and from the claims.

BRIEF DESCRIPTION OF THE DRAWINGS

FIG. 4 is waveforms decoded by various methods, in which FIG. 4A is an original waveform, FIG. 4B is a decoded waveform with no packet loss, FIG. 4C is a packet error pattern, FIG. 4D is a waveform decoded by an apparatus and a method according to an embodiment, and FIG. 4E is a waveform decoded by G.729.1-PLC.

DETAILED DESCRIPTION

Reference will now be made in detail to the embodiments of the present disclosure, examples of which are illustrated in the accompanying drawings.

Hereinafter, specific embodiments of the present invention will be described with reference to the accompanying drawings.

Figure 1:
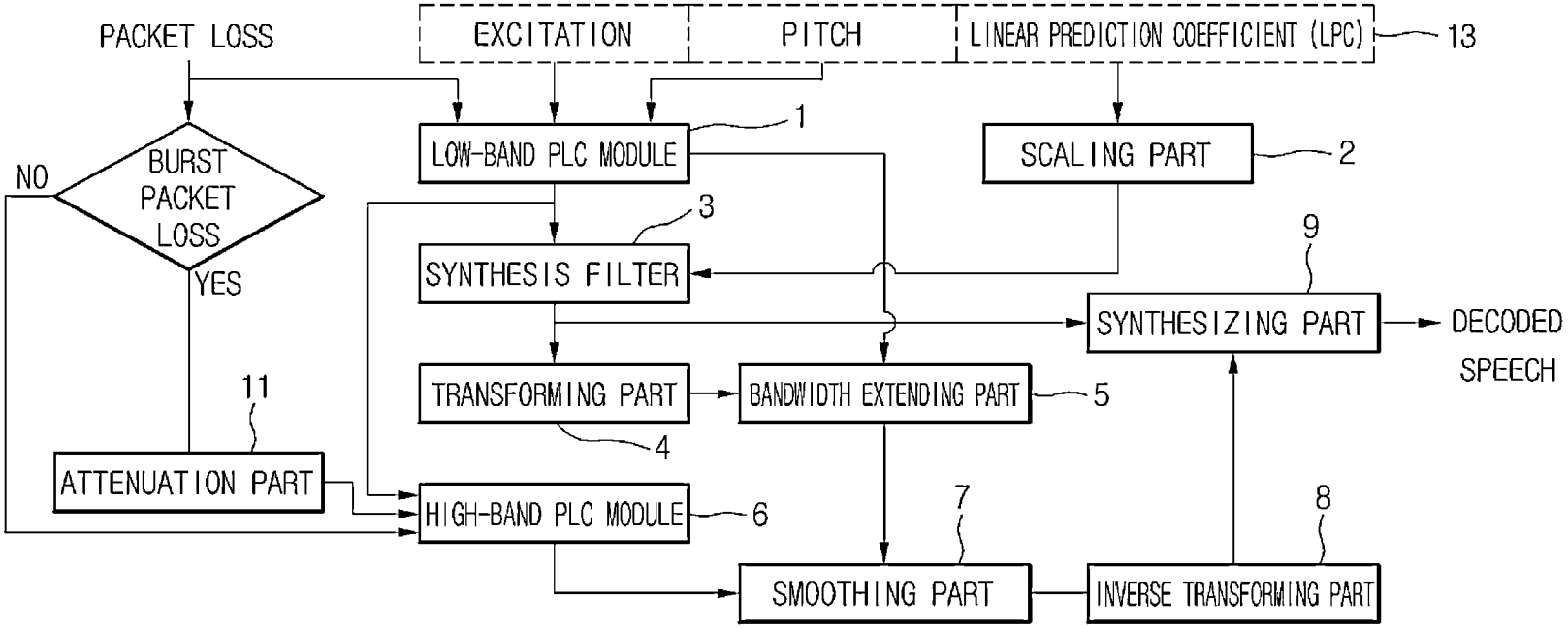
FIG. 1 is a schematic view of a speech receiving apparatus according to an embodiment.

FIG. 1 is a schematic view of a speech receiving apparatus according to an embodiment. The speech receiving apparatus according to an embodiment is based on the ITU-T G.729.1, scalable wideband speech coder. Therefore, description will be made with reference to ITU-T G.729.1. Further, although there is no concrete description in the following embodiments, it will be construed that description on the ITU-T G.729.1 is included in the description of the present embodiments within a scope that is not contradictory to the description of the present embodiments.

Referring to FIG. 1, the speech receiving apparatus reconstructs speech signals of a lost frame based on the speech parameters 13 correctly received from the last good frame (hereinafter, sometimes referred to as good frame or previous good frame) before a frame loss occurs. The speech receiving apparatus includes a low-band packet loss concealment (PLC) module 1 and a high-band PLC module 6 which are applied to frequencies lower and higher than 4 kHz in order to obtain a speech signal of a lost frame.

The low-band PLC module 1 reconstructs the speech signal in the low band lower than 4 kHz using excitation and pitch. The pitch of the lost frame may be supposed as the pitch of the last good frame. The excitation may replace the excitation of the lost frame by gradually attenuating energy of the excitation of the last good frame.

A synthesis filter 3 receives an output signal of the low-band PLC module 1, and a signal obtained by a scaling part 2 scaling linear predictive coding (LPC) coefficients of the previous good frame to reconstruct a low-band speech signal, and outputs the reconstructed low-band speech signal.

As seen from the above description, the reconstruction of the low-band speech signal is performed in a time domain. As mentioned above, the reconstruction of the low-band speech signal is the same as that of the PLC (hereinafter, ITU-T G.729.1 PLC) operating in ITU-T G.729.1. Therefore, it will be construed that the description on ITU-T G.729.1 PLC that is not included in the detailed description of the embodiments is included in the description of the present embodiment.

The regeneration of the low-band speech signal is executed in a time domain, whereas the regeneration of the high-band speech signal is executed in a frequency domain. In detail, in a high-band PLC module 6, the high-band parameters of the previous good frame are applied to the time domain bandwidth extension (TDBWE) by using the excitation generated by the low-band PLC module 1. Also, it is determined whether or not the occurring packet loss is a burst packet loss, when the occurring packet loss is the burst packet loss, an attenuating part 11 attenuates the MDCT coefficients of the last good frame by −3 dB to generate high-band MDCT coefficients of the lost frame. By the above description, the operation of the high-band PLC module 6 is the same as that of the ITU-T. G.729.1 PLC. Therefore, it will be construed that the description on ITU-T G.729.1 PLC that is not explained in the above embodiment is also included in the description of the present embodiment.

Meanwhile, it is known that when a packet loss occurs, the signal reconstructed from the low-band PLC algorithm is further enhanced, compared with the signal reconstructed from the high-band PLC algorithm. Therefore, the present embodiment is characterized in that the speech signal reconstructed using the low-band PLC algorithm is used in the high-band PLC algorithm, and will be described in detail.

In brief description, the low-band signal synthesized by the synthesis filter 3 is transformed to the frequency domain by a transforming part 4. A bandwidth extension part 5 extends the low-band MDCT coefficients using the artificial bandwidth extension technology to generate extension MDCT coefficients used in the high-band. Thereafter, the extension MDCT coefficients are smoothed by the MDCT coefficients obtained from the high-band PLC module 6 by a smoothing part 7. An inverse transforming part 8 applies an inverse MDCT (IMDCT) to the smoothed MDCT coefficients to obtain a smoothed high-band signal in the time domain.

Lastly, a synthesizing part 9 synthesizes the low-band speech signal outputted from the synthesis filter 3 and the high-band speech signal outputted from the inverse transforming part 8 by a quadrature mirror filter (QMF) synthesis to generate a speech signal.

Next, the configuration of the bandwidth extension part 5 will be described in detail. The bandwidth extension part 5 extends the bandwidth in different ways according to each frequency band of the high band so as to reconstruct an optimal high-band speech signal. For example, the bandwidth extension part 5 processes the low-band MDCT coefficients in different ways according to the 4-4.6 kHz, 4.6-5.5 kHz, and 5.5-7 kHz bands to reconstruct an optimal high-band speech signal.

Figure 2:
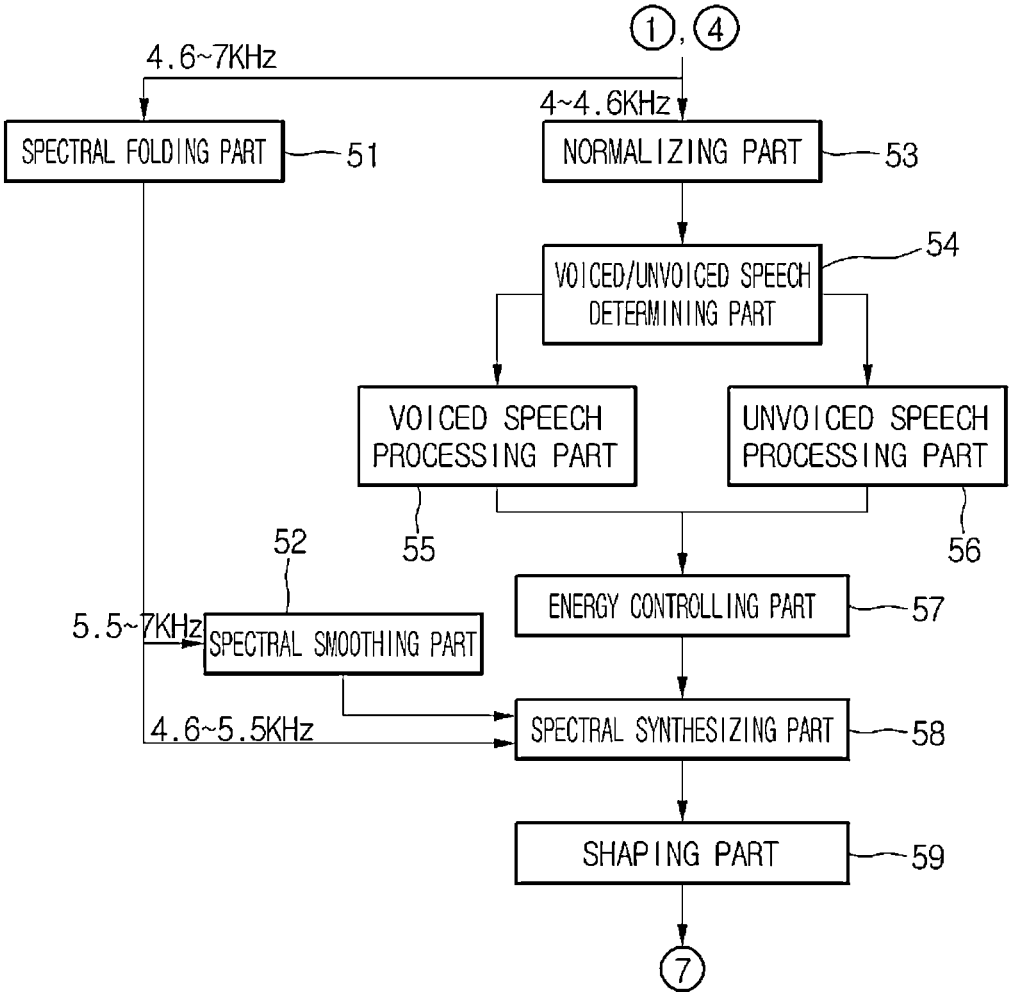
FIG. 2 is a schematic view of a bandwidth extension part according to an embodiment.

FIG. 2 is a schematic view of a bandwidth extension part according to an embodiment.

Referring to FIG. 2, the reconstructed low-band MDCT coefficients are inputted. At this time, the number N of samples as one frame size may be set to 160. The following description will be made based on the above-mentioned frame size.

A spectral folding part 51 folds a part of the low-band MDCT coefficients. At this time, original spectral components for generating the high-band MDCT coefficients may be represented by Equation 1.

$$S_f(k)=S_l(159-k),\ 24\leq k<120, \qquad \text{[Equation 1]}$$

where $S_l(k)$ denotes the low-band MDCT coefficient at the k-th frequency bin. Also, $S_f(k)$ is a spectral component in the high band, and is a mirror image of $S_l(k)$. Also, k in $S_f(k)$ changes from 24 to 119, which corresponds to 4.6-7 kHz when the number N of samples in one frame in the high band of 4-8 kHz is set to 160.

According to Equation 1, it may be known that the low-band MDCT coefficients are spectrally folded to the high-band. However, the present embodiment is not limited thereto. For example, the low-band MDCT coefficients may be shifted. A different method is not excluded. However, since the shifting method may exhibit a high energy difference in the low band and the high band, the spectral folding method is preferably considered.

In Equation 1, the spectral folding replicates harmonic components. Therefore, an unnaturally prominent harmonic structure may be produced at high frequencies of 5.5-7 kHz.

The harmonic structure may result in audible distortion. To avoid the audible distortion, the signal is low-pass filtered and smoothed by a spectral smoothing part 52. By doing so, a smoothed version $S_f(k)$ of $S_s(k)$ is obtained. $S_s(k)$ in the frequency range of 5.5-7 kHz is obtained by Equation 2.

$$S_s(k)=(0.25\cdot|S_f(k)|+0.75\cdot|S_s(k-1)|)\cdot sgn(S_f(k)) \quad \text{[Equation 2]}$$

where sgn(x) is equal to 1 if x is greater than or equal to 0; otherwise, it is equal to −1. Moreover, k in Equation 2 is the frequency bin index from 60 to 119, and $S_s$ (59)=$S_f$ (59). Equation 2 becomes a diffusion MDCT coefficient in the frequency range of 5.5-7 kHz.

The generation of the high-band MDCT coefficients in the range of 4-4.6 kHz will now be described. To generate the high-band MDCT coefficients in the range of 4-4.6 kHz, the low-band MDCT coefficients are grouped into 20 sub-bands with each sub-band having 8 MDCT coefficients. Consequently, the energy of the b-th sub-band E(b) is defined as Equation 3.

$$E(b)=\sqrt{\sum_{k=8\cdot b}^{8\cdot(b+1)-1} S_l^2(k)},\ 0\le b<20 \quad \text{[Equation 3]}$$

where $S_l(k)$ is the k-th low-band MDCT coefficient.

A normalizing part 53 uses E(b) in Equation 3 to normalize each MDCT coefficient belonging to the b-th sub-band as Equation 4.

$$\bar{S}_l(k)=\frac{S_l(k)}{E(b)},\ 8b\le k<8(b+1) \quad \text{[Equation 4]}$$

and $0\le b<20$ where $\bar{S}_l(k)$ denotes the k-th normalized low-band MDCT coefficient.

The artificial bandwidth extension (ABE) algorithm operates differently depending on the voicing characteristics of input speech. This has a purpose to aggressively reflect a change in high-band MDCT coefficient characteristic according to the voiced or unvoiced speech. To accomplish this purpose, a voiced/unvoiced speech determining part 54 classifies each frame as either a voiced or an unvoiced frame. To determine the voiced or unvoiced speech, the present embodiment employs the spectral tilt parameter $S_t$. The spectral tilt parameter $S_t$ is identical to the first reflection coefficient $k_1$, from the ITU-T G.729.1 decoder. As one example for determination of the voiced or unvoiced speech, if the spectral tilt parameter $S_t$ is a right upper curve, then it is determined to be the voiced speech, and if the spectral tilt parameter $S_t$ is a right lower curve, then it is determined to be the unvoiced speech. Therefore, if $S_t$ of the current frame is greater than a predefined threshold $\theta_{St}$, then this frame is declared as a voiced frame; otherwise, it is as an unvoiced frame.

When the voiced/unvoiced speech determining part 54 determines that the frame is the voiced frame, a voiced speech processing part 55 processes the normalized low-band MDCT coefficient. The operation of the voiced speech processing part 55 will be described in detail. In order to generate high-band MDCT coefficients with harmonic characteristics, the harmonic period in the MDCT domain is determined as $\Delta_v$=2N/T, where T is the pitch value, and N is the number of samples every one frame, which may be set to 160 in the description of the present embodiment. Subsequently, the k-th harmonic MDCT coefficient $\bar{S}_l'(k)$ is expressed as Equation 5.

$$\bar{S}_l'(k)=\bar{S}_l\left(k+\frac{N}{2}-\lfloor\Delta_v-\mathrm{mod}(N,\Delta_v)\rfloor\right),\ 0\le k<2, \quad \text{[Equation 5]}$$

where $\bar{S}_l(k)$ denotes the normalized low-band MDCT coefficient described in Equation 4. Also, mod(x, y) indicates the modulus operation defined as mod(x, y)=x % y. In addition, ⌊x⌋ denotes the largest integer less than or equal to x. In Equation 5, k is set to 0≤k<24 so as to correspond to the frequency range of 4-4.6 kHz. According to Equation 5, in the voiced speech, the high-band MDCT coefficient with harmonic spectral characteristics consecutive from the low band may be reconstructed.

When the voiced/unvoiced speech determining part 54 determines that the frame is the unvoiced frame, the unvoiced speech processing part 56 processes the normalized low-band MDCT coefficient. The operation of the unvoiced speech processing part 56 will be described in detail. First, in order to reconstruct the high-band MDCT coefficients from the low-band MDCT coefficients for an unvoiced frame, a proper lag value, which maximizes the autocorrelation corr($\bar{S}_l(k)$, $\bar{S}_l(k+m)$) between the normalized low-band MDCT coefficients $\bar{S}_l(k)$, is defined as Equation 6.

$$\Delta_{uv}=\underset{0\le m\le N/4-1}{\mathrm{argmax}}\,[corr(\bar{S}_l(k),\bar{S}_l(k+m))], \quad \text{[Equation 6]}$$

where argmax(x) denotes the value of x, which maximizes the result value, and $\Delta_{uv}$ denotes the proper lag value for reconstruction. In more detail, $\Delta_{uv}$ is to find out the interval of m which satisfies the maximum correlation. In Equation 6, the autocorrelation may be represented as Equation 7.

$$corr(\bar{S}_l(k),\bar{S}_l(k+m))=\sum_{k=0}^{N/4-1}\bar{S}_l\left(k+\frac{3}{4}N\right)\bar{S}_l(k+m) \quad \text{[Equation 7]}$$

where m is an integer from 0 to N/4−1. Finally, the MDCT coefficient that is most correlated to $\bar{S}_l(k)$ in the range of 3-4 kHz, $\bar{S}_l'(k)$ is obtained as Equation 8.

$$\bar{S}'_l=\bar{S}_l(k+\tfrac{1}{4}N+\Delta_{uv}),0\le k<24 \quad \text{[Equation 8]}$$

According to Equation 8, in the unvoiced speech, the high-band MDCT coefficient may be reconstructed by extracting the greatest autocorrelation section from the low band.

In order to avoid an abrupt change in energy at the high band after patching the high-band MDCT coefficients from the low band, it is preferable that the amplitude of each high-band MDCT coefficient should be controlled.

For this purpose, an energy controlling part 57 controls the energy of the high-band MDCT coefficient. First of all, the energy for the b-th high-band, $E_h$ (b) is defined from E(b) in Equation 3 as Equation 9.

$$E_h(b)=\begin{cases}\alpha E(b+16), & \text{if } E(b+17)>\alpha E(b+16)\\ E(b+17), & \text{otherwise,}\end{cases} \quad \text{[Equation 9]}$$

$0\le b\le 2$ where α is set to 1.25 in this embodiment.

Next, the amplitude of each high-band MDCT coefficient in the range of 4-4.6 kHz is controlled as Equation 10.

$$\bar{S}_h(k)=\bar{S}'_l(k)E_h(2-b),\ b=\lfloor k/8 \rfloor,\ 0\le k<24 \quad \text{[Equation 10]}$$

As seen from Equation 10, the energy controlling part 57 controls the output energy.

As described above, the first frequency range of 4-4.6 kHz is outputted from the energy controlling part 57, and uses the MCT coefficient represented as Equation 10. The second frequency range of 4.6-5.5 kHz is outputted from the spectral folding part 51, and uses the MDCT coefficient represented as Equation 1. Lastly, the third frequency range of 5.5-7 kHz is outputted from the spectral smoothing part 52, and uses the MDCT coefficient represented as Equation 2. Thus, by differently processing the low-band MDCT coefficients according to the frequency range, the high-band MDCT coefficients may be reconstructed to thus obtain an optimal high-band speech signal.

A spectral synthesizing part 58 combines the MDCT coefficients according to the frequency range to obtain the high-band extended MDCT coefficient $S'_h(k)$. The high-band extended MDCT coefficient $S'_h(k)$ is represented as Equation 11.

$$S'_h(k)=\begin{cases}\bar{S}_h(k), & 0\le k<24\\ S_f(k), & 24\le k<60\\ S_s(k), & 60\le k<120\end{cases} \quad \text{[Equation 11]}$$

The spectrum represented by the extended MDCT coefficients has an excessively fine structure at high frequencies, which results in musical noise. In order to mitigate such a problem, in this embodiment, a shaping part 59 is further provided. The shaping part 59 employs a shaping function to mitigate the musical noise problem. In an example, a cubic spline interpolation is used. The cubic spline interpolation may have a not-a-knot condition around four control points at 4, 5, 6, and 7 kHz with 0, −6, −12, and −18 dB, respectively. Consequently, the extended MDCT coefficients are modified by the shaping part 59 applying the spline function as Equation 12.

$$S_{abe}(k)=S'_h(k)\cdot 10^{0.05\cdot\sigma(k)}, \quad \text{[Equation 12]}$$

where σ(k) is a value obtained after applying the spline function.

The extended MDCT coefficients outputted from the shaping part 59 is transmitted to the smoothing part 7 of FIG. 1.

The smoothing part 7 suppresses abrupt changes in the high-band MDCT coefficients of the lost frame. For this purpose, $S_{abe}(k)$ in Equation 12 is smoothed with the high-band MDCT coefficient outputted from the high-band PLC module 6, $S_h(k)$. $S_h(k)$ is regarded as the MDCT coefficient obtained from the high-band PLC module 6 in the ITU-T G.729.1 decoder.

Resultantly, the smoothed high-band MDCT coefficient $\hat{S}_h(k)$, which is smoothed by the smoothing part 7, is obtained by Equation 13.

$$\hat{S}_h(k)=(|S_h(k)|),\ 0\le k<120 \quad \text{[Equation 13]}$$

Next, $\hat{S}_h(k)$ is IMDCT-transformed to the time domain by the inverse transforming part 8. Finally, the synthesizing part 9 synthesizes the reconstructed low-band speech signal and the reconstructed high-band speech signal using a QMF synthesis filter to thus complete the wideband speech signal.

Figure 3:
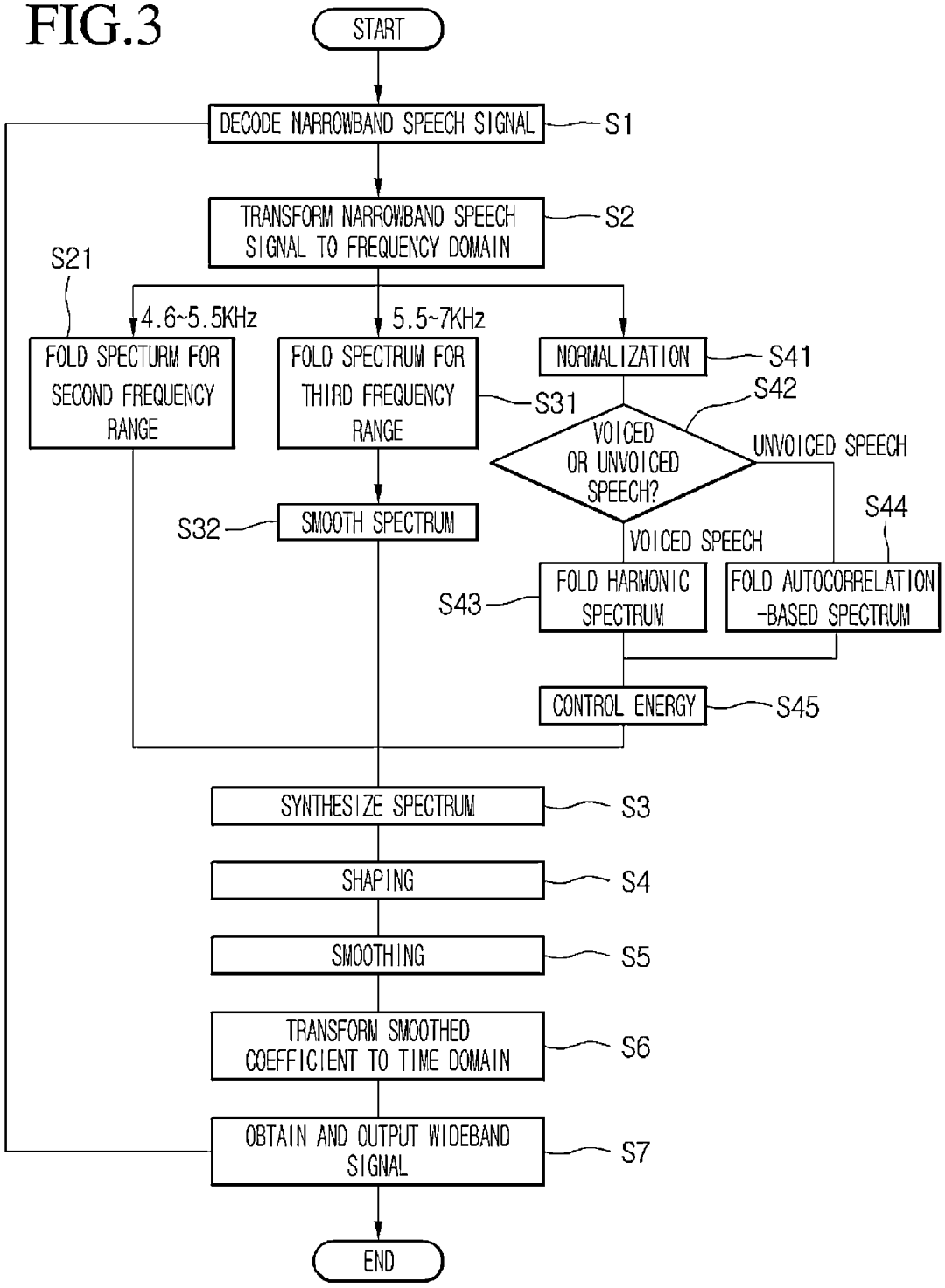
FIG. 3 is a flow diagram of a speech receiving method according to an embodiment.

FIG. 3 is a flow diagram of a speech receiving method according to an embodiment.

Referring to FIG. 3, a narrowband speech signal is reconstructed through the low-band PLC algorithm applied to the ITU-T G.729.1 (S1). The low-band PLC algorithm may be performed by the low-band PLC module 1, the scaling part 2, and the synthesis filter 3. The reconstructed narrowband speech signal is transformed to a frequency domain by the transforming part 4 to provide a low-band MDCT coefficient (S2).

For example, the first frequency range of 4-4.6 kHz is outputted from the energy controlling part 57, and uses the MDCT coefficient represented as Equation 10. The second frequency range of 4.6-5.5 kHz is outputted from the spectral folding part 51, and uses the MDCT coefficient represented as Equation 1. Lastly, the third frequency range of 5.5-7 kHz is outputted from the spectral smoothing part 52, and uses the MDCT coefficient represented as Equation 2. Consequently, the optimal high-band extended MDCT coefficients are obtained through different coefficient processes. In particular, the reason the frequency range of 4-4.6 kHz is subject to a separate MDCT coefficient process is because the frequency range transmitted in the narrowband speech communication is mainly limited up to 3.4 kHz and thus the MDCT coefficient of the corresponding frequency range may not be obtained through a general spectral folding. Like the wideband communication network, in the case where a speech signal with the frequency up to 4 kHz is transmitted, a separate MDCT coefficient process for the first frequency range may not be required.

First, the second frequency range of 4.6-5.5 kHz may be provided by the spectral folding part 51 replicating, preferably folding the low-band MDCT coefficient (S21). The third frequency range of 5.5-7 kHz may be provided by the spectral folding part 51 folding the low-band MDCT coefficient (S32) and smoothing the spectrum. Since the audible distortion on the harmonic component is severe, the second frequency range is subject to the smoothing process so as to suppress such a distortion.

In the first frequency range of 4-4.6 kHz, the low-band MDCT coefficient is normalized to obtain the normalized low-band MDCT coefficient (S41), the characteristics of the low-band MDCT are grasped and then it is determined whether the speech is a voiced or unvoiced sound (S42), when the speech is a voiced sound, the harmonic spectral replication is performed (S43), and when the speech is a unvoiced sound, the correlation-based spectral replication to replicate the spectrum (S44) is performed. Subsequently, energy is controlled (S45).

More specifically, the normalizing part 53 may group the low-band MDCT coefficients into a plurality of sub-bands, and then perform the normalization by calculating energy for each sub-band with respect to the frequency range coefficients for the respective sub-bands. For example, when the low-band MDCT coefficients are grouped into 20 sub-bands, each sub-band may include 8 MDCT coefficients (S41).

The voiced/unvoiced speech determining part 54 may use the spectral tilt parameter so as to determine whether each frame is a voiced or unvoiced frame. The spectral tilt parameter is identical to the first reflection coefficient, from the ITU-T G.729.1 decoder. As one example for determination of the voiced or unvoiced sound, if the spectral tilt parameter is a right upper curve, then it is determined as the voiced sound, and if the spectral tilt parameter is a right lower curve, then it is determined as the unvoiced sound (S42).

In the determining (S42) of the voiced or unvoiced sound, the current frame may be determined to be the voiced frame. At this time, the high-band extended MDCT coefficient having the consecutive harmonic characteristic is reconstructed from the low-band MDCT coefficient by using the pitch value and the number of samples every frame (S43). In the determining (S42) of the voiced or unvoiced sound, the current frame may be determined to be the unvoiced frame. At this time, the correlation between the respective frequency domains for the range determined to be the unvoiced speech in the normalized MDCT coefficient is determined, and the high-band MDCT coefficient is reconstructed by extracting the domain having the highest correlation (S44).

The energy controlling part 57 controls the extended MDCT coefficient to reduce abrupt change in energy when the low-band speech signal is transformed into the high-band speech signal (S45). By doing so, the abrupt change in energy at a frequency boundary portion may be controlled through scaling.

The extended MDCT coefficient reconstructed in each frequency range is synthesized in each frequency range by the spectral synthesizing part 58 (S32). Thereafter, in order to mitigate fine musical noise generated in the high frequency range in the spectrum displayed by the synthesized extended MDCT coefficients, the shaping part 59 applies the shaping function (S4). The smoothing part 7 smoothes the high-band extended MDCT coefficient using the high-band MDCT coefficient outputted from the high-band PLC module 6 in order to inhibit the high-band extended MDCT coefficients of the lost frame from being abruptly changed (S5).

Thereafter, the smoothed high-band MDCT coefficient is transformed to the time domain by the inverse transforming part 8 (S6), and then is synthesized by the synthesizing part 9. The synthesizing part 9 synthesizes the reconstructed low-band speech signal and the reconstructed high-band speech signal to obtain a wideband signal and outputs the obtained wideband signal (S7). At this time, for the synthesis of the low band and the high band, the QMF method may be used.

The speech receiving apparatus according to the embodiment was compared with the speech receiving apparatus of the ITU-T G.729.1 for evaluation. The comparison was done in terms of log spectral distortion (LSD) and waveforms and using an A-B preference test.

For the comparison, 3 male voices, 3 female voices, and 2 music files were prepared from the speech quality assessment material (SQAM) audio database. In particular, since the SQAM audio files were recorded in stereo at a sampling rate of 44.1 kHz, they were down-sampled to 8 kHz and 16 kHz, respectively, and then generated as mono signals. In addition, two different packet loss conditions such as random and burst packet losses were simulated. The packet loss rates of 10%, 20%, and 30% were generated by the Gilbert-Elliot model defined in ITU-T Recommendation G.191.15. For the burst packet loss condition, the burstiness of the packet losses was set to 0.99; thus, the maximum and minimum consecutive packet losses were measured at 1.9 and 5.6 frames, respectively.

First, the log spectral distortion (LSD) was measured between the original and decoded signal. Tables 1 and 2 show a comparison of the LSD performances of the PLC according to the embodiment and the G.729.1-PLC under random and burst packet loss conditions at packet loss rates of 10%, 20%, and 30% for the speech and music files, respectively.

TABLE 1

| Burstiness/Packet Loss Rate (%) | | G.729.1-PLC (dB) | Proposed PLC (dB) |
|---|---|---|---|
| r = 0.0 | 10 | 10.04 | 10.00 |
| | 20 | 10.90 | 10.81 |
| | 30 | 11.78 | 11.63 |

TABLE 1-continued

| Burstiness/Packet Loss Rate (%) | | G.729.1-PLC (dB) | Proposed PLC (dB) |
|---|---|---|---|
| r = 0.99 | 10 | 10.28 | 10.20 |
| | 20 | 11.02 | 10.85 |
| | 30 | 11.92 | 11.75 |
| Average | | 10.99 | 10.87 |

TABLE 2

| Burstiness/Packet Loss Rate (%) | | G.729.1-PLC (dB) | Proposed PLC (dB) |
|---|---|---|---|
| r = 0.0 | 10 | 17.93 | 17.89 |
| | 20 | 18.24 | 18.16 |
| | 30 | 18.55 | 18.28 |
| r = 0.99 | 10 | 18.35 | 18.30 |
| | 20 | 18.62 | 18.50 |
| | 30 | 18.68 | 18.34 |
| Average | | 18.40 | 18.25 |

It was observed from the tables that the spectral distortion of the proposed PLC algorithm was more reduced than that of the G.729.1-PLC algorithms under all conditions.

Figure 4:
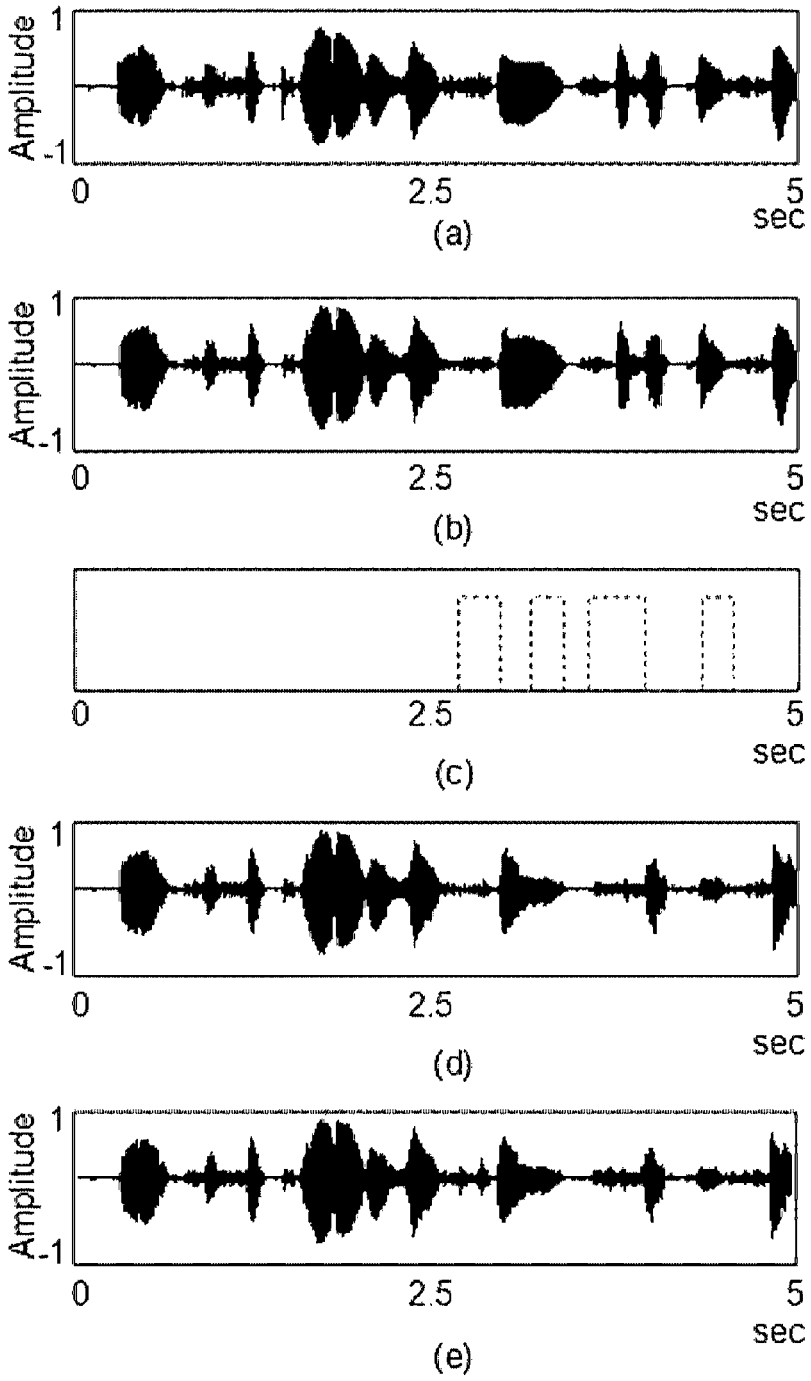

The waveform test results will be described. FIG. 4 shows waveforms decoded by various methods, in which FIG. 4A is an original waveform, FIG. 4B is a decoded waveform with no packet loss, FIG. 4C is a packet error pattern, FIG. 4D is a waveform decoded by an apparatus and a method according to an embodiment, and FIG. 4E is a waveform decoded by G.729.1-PLC. It may be seen that the waveform reconstructed by the speech receiving apparatus and the speech receiving method according to the embodiments has more excellent performance than that reconstructed by the G.729.1-PLC.

Next, an A-B preference listening test result will be described. The A-B preference listening test was performed, in which 3 male, 3 female voices, and 2 music files were processed by both the G.729.1-PLC and the speech receiving apparatus according to the embodiment under random and burst packet loss conditions. Tables 3 and 4 show the A-B preference test results for the speech and music data, respectively.

TABLE 3

| Burstiness/Packet Loss Rate (%) | | G.729.1-PLC | No Difference | Proposed PLC |
|---|---|---|---|---|
| r = 0.0 | 10 | 21.43 | 45.24 | 33.33 |
| | 20 | 28.57 | 35.71 | 35.72 |
| | 30 | 19.05 | 54.76 | 26.19 |
| r = 0.99 | 10 | 14.29 | 52.38 | 33.33 |
| | 20 | 26.19 | 40.48 | 33.33 |
| | 30 | 16.67 | 47.62 | 35.71 |
| average | | 21.03 | 46.03 | 32.94 |

TABLE 4

| Burstiness/Packet Loss Rate (%) | | G.729.1-PLC | No Difference | Proposed PLC |
|---|---|---|---|---|
| r = 0.0 | 10 | 21.43 | 50.00 | 28.57 |
| | 20 | 14.29 | 57.14 | 28.57 |
| | 30 | 28.57 | 42.86 | 28.57 |

TABLE 4-continued

| Burstiness/Packet Loss Rate (%) | | G.729.1-PLC | No Difference | Proposed PLC |
|---|---|---|---|---|
| r = 0.99 | 10 | 21.43 | 42.86 | 35.71 |
| | 20 | 21.43 | 35.71 | 42.86 |
| | 30 | 7.14 | 57.14 | 35.72 |
| average | | 19.05 | 47.62 | 33.33 |

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A speech receiving apparatus comprising:

a low-band packet loss concealment (PLC) module and a synthesis filter reconstructing a low-band speech signal of a lost frame from a previous good frame;

a high-band PLC module reconstructing a high-band speech signal of the lost frame from the previous good frame;

a transforming part transforming the low-band speech signal to a frequency domain;

a bandwidth extending part generating at least an extended modified discrete cosine transform (MDCT) coefficient as information for the high-band speech signal from the low-band speech signal transformed by the transforming part;

a smoothing part smoothing the extended MDCT coefficient;

an inverse transforming part inversely transforming the extended MDCT coefficient smoothed by the smoothing part to a time domain; and a synthesizing part synthesizing the low-band speech signal, and the high-band speech signal that is inverse-transformed by the inverse transforming part and reconstructed, to output a wideband speech signal;

wherein the bandwidth extending part performs spectral folding of low-band MDCT coefficients to generate at least a part of the extended MDCT coefficients.

2. The speech receiving apparatus of claim 1, wherein the bandwidth extending part comprises at least two processing parts generating the extended MDCT coefficient by a different process according to the frequency range.

3. The speech receiving apparatus of claim 1, wherein the bandwidth extending part comprises a spectral folding part and a spectral smoothing part, generating at least a part of the extended MDCT coefficients by folding and smoothing the MDCT coefficients of the low-band speech signal.

4. The speech receiving apparatus of claim 1, wherein the bandwidth extending part comprises a voiced/unvoiced speech determining part utilizing the MDCT coefficients of the low-band speech signal by different processes according to a voiced or unvoiced speech.

5. The speech receiving apparatus of claim 4, wherein the bandwidth extending part comprises a voiced speech processing part performing a harmonic spectral folding when an input speech is determined to be the voiced speech by the voiced/unvoiced speech determining part.

6. The speech receiving apparatus of claim 4, wherein the bandwidth extending part comprises an unvoiced speech processing part performing a spectral folding of a high autocorrelation section from the low band when an input speech is determined to be the unvoiced speech by the voiced/unvoiced speech determining part.

7. The speech receiving apparatus of claim 4, wherein the voiced/unvoiced speech determining part determines the voiced or unvoiced speech according to a tilt of a spectral tilt parameter.

8. The speech receiving apparatus of claim 1, wherein, in the bandwidth extending part, the extended MDCT coefficient for a second frequency range is generated by folding the MDCT coefficient of the low-band speech signal, the extended MDCT coefficient for a third frequency range higher than the second frequency range is generated by folding and smoothing the MDCT coefficient of the low-band speech signal, the extended MDCT coefficient for a first frequency range lower than the second frequency range is generated by differently processing the MDCT coefficient of the low-band speech signal according to whether an input speech is a voiced or unvoiced speech.

9. The speech receiving apparatus of claim 8, wherein the first frequency range is 4-4.6 kHz, the second frequency range is 4.6-5.5 kHz, and the third frequency range is 5.5-7 kHz.

10. The speech receiving apparatus of claim 1, wherein the bandwidth extending part comprises a shaping part shaping the extended MDCT coefficient that is generated by a different process according to the frequency range and then synthesized.

11. A speech receiving method comprising:

reconstructing a low-band speech signal of a lost frame from a previous good frame;

transforming the reconstructed low-band speech signal to a frequency domain to provide a low-band modified discrete cosine transform (MDCT) coefficient;

processing the low-band MDCT coefficient by different methods according to the frequency ranges of the high band, which are classified into at least two cases, to provide an extended MDCT coefficient of a high-band speech signal;

inversely transforming the extended MDCT coefficient to a time domain to reconstruct the high-band speech signal; and synthesizing the reconstructed high-band speech signal and the low-band speech signal;

wherein a second frequency range that is a part of the extended MDCT coefficients is obtained by folding the low-band MDCT coefficient.

12. The speech receiving method of claim 11, prior to the reconstructing of the high-band speech signal, further comprising smoothing the high-band extended MDCT coefficient using the high-band MDCT coefficient reconstructed in the previous good frame in order to inhibit the high-band extended MDCT coefficients from being abruptly changed.

13. The speech receiving method of claim 11, wherein a third frequency range that is a part of the extended MDCT coefficients and is higher than the second frequency range is obtained by folding and smoothing the low-band MDCT coefficient.

14. The speech receiving method of claim 11, wherein a third frequency range that is a part of the extended MDCT coefficients utilizes the low-band MDCT coefficient by using different methods according to whether an input speech is a voiced or unvoiced speech.

15. The speech receiving method of claim 14, wherein, when the input speech is the voiced speech, the extended MDCT coefficient is obtained by using the low-band MDCT coefficient by a harmonic spectral replication method.

16. The speech receiving method of claim 14, wherein, when the input speech is the unvoiced speech, the extended MDCT coefficient is obtained by using the low-band MDCT coefficient by an autocorrelation spectral replication method.

* * * * *